United States Patent [19]

Halliday et al.

[11] Patent Number: 4,756,776

[45] Date of Patent: Jul. 12, 1988

[54] PROCESS FOR THE PRODUCTION OF AN EXPLOSIVE AND THE EXPLOSIVE

[75] Inventors: Pieter S. J. Halliday, Randburg; Carl H. Lubbe, Johannesburg; Lynette Swartz, Bedfordview, all of South Africa

[73] Assignee: AECI Limited, Johannesburg, South Africa

[21] Appl. No.: 70,721

[22] Filed: Jul. 7, 1987

[30] Foreign Application Priority Data

Jul. 7, 1986 [ZA] South Africa ..... 86/5028
Jul. 7, 1986 [ZA] South Africa ..... 86/5029

[51] Int. Cl.[4] ..... C06B 45/02

[52] U.S. Cl. ..... 149/2; 149/21; 149/109.6; 149/40; 149/60; 102/430

[58] Field of Search ..... 149/60, 2, 40, 109.6, 149/21; 102/430

[56] References Cited

U.S. PATENT DOCUMENTS 4,357,184 11/1982 Binet et al. ..... 149/2
4,448,619 5/1984 Mitchell ..... 149/40
4,491,489 1/1985 Ellis et al. ..... 149/2
4,500,369 2/1985 Tag et al. ..... 149/2
4,548,659 10/1985 Jessop ..... 149/20
4,566,919 1/1986 Jessop ..... 149/20
4,678,524 7/1987 Cranney et al. ..... 149/2

*Primary Examiner*—Stephen J. Lechert, Jr.
*Attorney, Agent, or Firm*—Cushman, Darby & Cushman

[57] ABSTRACT

In a process for the production of a 'water-in-fuel' or 'melt-in-fuel' emulsion explosive a density-reducing agent is introduced and dispersed in the emulsion at an elevated temperature whereat the emulsion is essentially liquid, the explosive is cartridged and then subsequently cooled by means of a refrigerated fluid so that the continuous phase solidifies and stabilizes the dispersion of the density-reducing agent in the explosive. Preferably, when the density-reducing agent comprises gas bubbles the explosive is subjected to an elevated pressure before it is cartridged in order to ensure that the sensitivity of the explosive will not be impaired by disturbance of gas bubbles by any pressure drop which might occur during cartridging.

12 Claims, 2 Drawing Sheets

PROCESS FOR THE PRODUCTION OF AN EXPLOSIVE AND THE EXPLOSIVE

Figure 1:
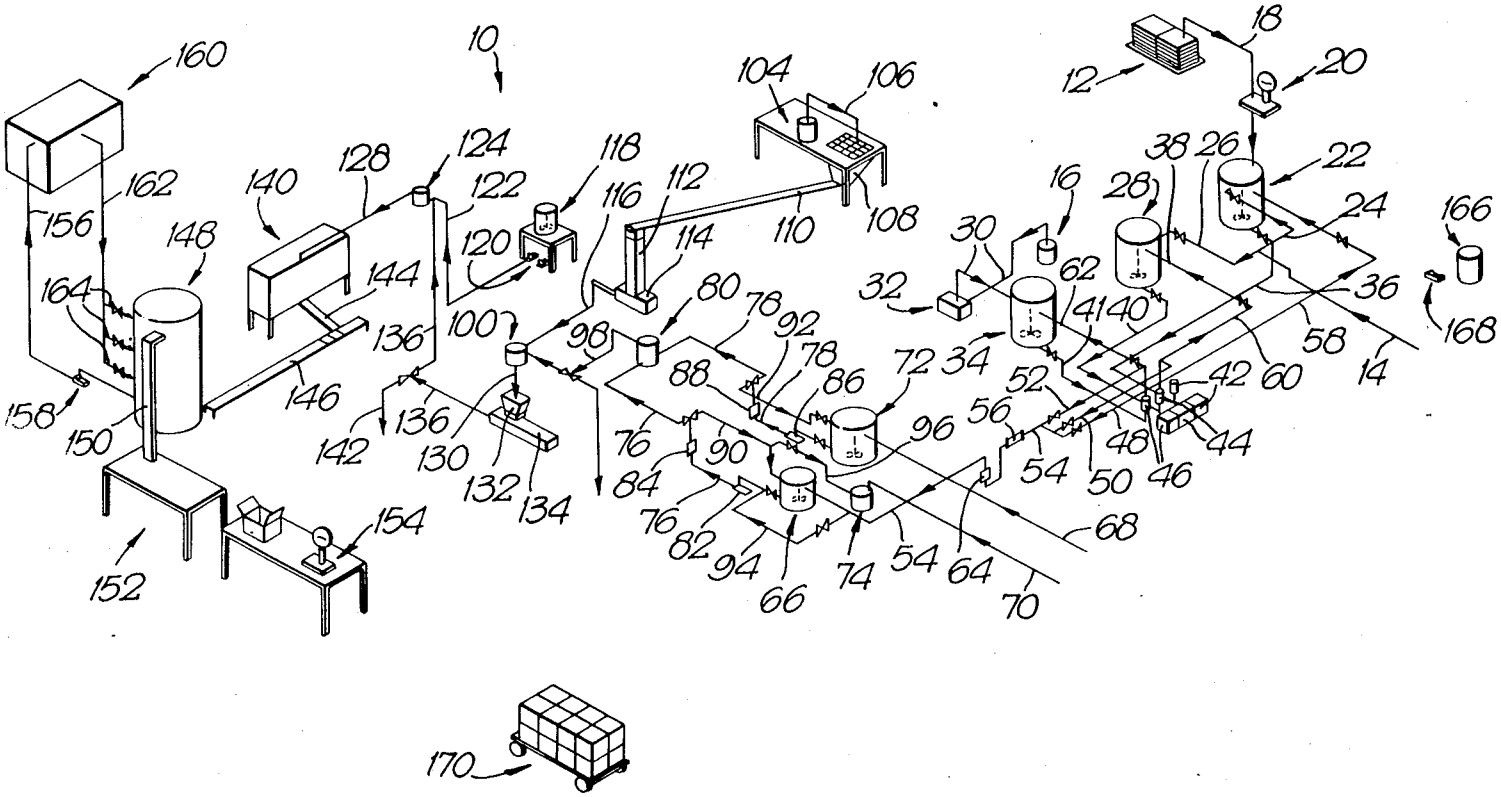

This invention relates to explosives. More particularly it relates to a process for the production of an explosive of the emulsion type in which an oxidizing salt-containing component forms the discontinuous phase in an emulsion wherein a continuous phase which is immiscible with the discontinuous phase forms a fuel component.

Such explosives often have water in their oxidizing salt-containing component and can be regarded as "water-in-fuel" emulsions, but in cases where the oxidizing salt-containing component contains no water, they can be regarded as "melt-in-fuel" emulsions.

According to the invention, in the production of a cartridged explosive in the form of an emulsion which comprises a discontinuous phase which forms an oxidizing salt-containing component and a continuous phase which is immiscible with the discontinuous phase and which forms a fuel component which is solid at ambient temperatures, there is provided a process which comprises the steps of introducing a density-reducing agent into the emulsion and dispersing it therein while the emulsion is at an elevated temperature and is essentially liquid to form an explosive, cartridging the explosive containing the density reducing agent, and then cooling the cartridged explosive by means of a refrigerated fluid so that the continuous phase solidifies, thereby to entrap the density-reducing agent and stabilize its dispersion in the explosive.

The cooling is preferably effected by forced cooling whereby the refrigerated fluid is caused to flow over the cartridged explosive.

A solid fuel, such as atomized aluminum, may, if required, be blended in together with the density reducing agent, in the blending step, to add to the energy of the explosive.

The present invention will thus involve the selection of a continuous phase, or at least components thereof, so that the continuous phase is substantially solid at ambient temperatures, and has a softening point above ambient temperatures. At temperatures above softening point, the continuous phase should have a sufficiently low viscosity to permit formation of the emulsion itself, and to permit introduction and dispersion of gas bubbles therein, at normal elevated working temperatures.

Elevated working temperatures typically encountered in the art for emulsion formation, at which temperatures the viscosity of the continuous phase should be sufficiently low for bubble introduction and dispersion, are in the region of 85°-95° C.; and ambient temperatures of below about 35° C. are typically encountered. By suitable selection of eg waxy components in the continuous phase, such as paraffin waxes and/or microcrystalline waxes, and the proportions thereof, a continuous phase can easily be formulated with a softening point above 35° C. and a sufficiently low viscosity at 85°-95° C. Naturally, these temperatures are somewhat arbitrary, and if the explosive is intended for use at different, eg higher, ambient temperatures, and if the working temperatures for making and gassing the emulsion will be different, the continuous phase should be formulated accordingly, by routine experimentation if necessary.

The elevated temperature at which the density-reducing agent is blended with the emulsion may thus be 85°-95° C.

The density reducing agent may comprise gas bubbles or it may comprise a closed-cell void containing material such as glass or plastics microballoons or microspheres, particles of expanded perlite or the like. When the density reducing agent is particulate, it may be introduced into the base emulsion by means of a suitable blender. When the density reducing agent comprises gas bubbles they may be introduced by physically dispersing, eg in a suitable blender or mixer such as a pin mill or static mixer, an inert gas such as nitrogen into the emulsion. Instead, a chemical gassing agent may be dispersed into the emulsion in a similar fashion, the gassing agent reacting with the emulsion or with a constituent thereof, to form the bubbles before the continuous phase of the emulsion solidifies.

Typically the discontinuous phase may comprise at least one oxidizing salt selected from the group consisting in:

ammonium nitrate
alkali metal nitrates
alkaline earth metal nitrates
ammonium perchlorate
alkali metal perchlorates; and
alkaline earth metal perchlorates.

The oxidizing salt will be present in the form of an aqueous solution or melt in the discontinuous phase.

In the case of melt-in-fuel emulsions or emulsions in which the discontinuous phase contains very little if any water, the discontinuous phase can solidify at ambient temperatures, but the explosive is still regarded as an emulsion for the purpose of the present invention.

The discontinuous phase may comprise ammonium nitrate with at least one further compound selected from the group consisting in oxygen-releasing salts and fuels which, together with the ammonium nitrate, forms a melt which has a melting point which is lower than that of ammonium nitrate. Such further compound may be an inorganic salt such as lithium nitrate, silver nitrate, lead nitrate, sodium nitrate, calcium nitrate, potassium nitrate, or mixtures thereof. Instead or in addition, the compound which together with the ammonium nitrate on heating forms a melt having a melting point which is lower than the melting point of ammonium nitrate may be an alcohol such as methyl alcohol, ethylene glycol, glycerol, mannitol, sorbitol, pentaerythritol, or mixtures thereof. Other compounds which can instead or in addition be used to form the melt together with ammonium nitrate may be carbohydrates such as sugars, starches and dextrins, and aliphatic carboxylic acids and their salts such as formic acid, acetic acid, ammonium formate, sodium formate, sodium acetate, and ammonium acetate. Yet further compounds which can instead or in addition be used to form melts with ammonium nitrate include glycine, chloracetic acid, glycolic acid, succinic acid, tartaric acid, adipic acid, and lower aliphatic amides such as formaide, acetamide and urea. Urea nitrate can also be used as can certain nitrogenous substances such as nitroguanidine, guanidine nitrate, methylamine, methylamine nitrate, and ethylene diamine dinitrate. Each of these substances may be used alone with the ammonium nitrate, or mixtures thereof can be used to form the melt of the ammonium nitrate, the mixtures being selected to form melts with the ammonium nitrate having suitably low melting points and being substantially insoluble in the continuous phase.

In general, the substance(s) chosen to form melts with the ammonium nitrate are selected by the criterion, in addition to costs, that they form melts with acceptably safe and low melting points, for example, within the range 80° C. to 130° C., although melts with melting points above 130° C. can in principle be used.

The fuel will be immiscible with and insoluble in water, and is preferably an organic fuel which may be non-self-explosive and may comprise at least one member of the group comprising hydrocarbons, halogenated hydrocarbons and nitrated hydrocarbons. As mentioned above, the fuel typically contains one or more waxes, such as paraffin waxes, microcrystalline waxes and/or slack waxes, whereby its softening point and viscosity are controlled, and it may also include one or more members of the group comprising mineral oils, fuel oils, lubricating oils, liquid paraffin, xylene, toluene, petrolatum and dinitrotoluene.

In general, water in the discontinuous phase will be kept to a minimum consistent with formulating the discontinuous phase and with formulating the emulsion at an elevated temperature which is acceptably low, so as to avoid unnecessarily wasted energy arising from steam production upon eventual detonation.

The fuel component of the emulsion may comprise at least one emulsifier selected from the group consisting in sorbitan sesquioleate, sorbitan monooleate, sorbitan monopalmitate, sodium monostearate, sodium tristearate, the mono- and diglycerides of fat-forming fatty acids, soya bean lecithin, derivatives of lanolin, alkyl benzene sulphonates, oleyl acid phosphate, laurylamine acetate, decaglycerol decaoleate, decaglycerol decastearate, 2-oleyl-4-4'-bis(hydroxymethyl)-2-oxazoline, polymeric emulsifiers containing polyethylene glycol backbones with fatty acid side chains and polyisobutylene succinic anhydride derivatives.

The emulsifiers act as surfactants and stabilizers to promote the formation of the emulsion and to resist crystallization and/or coalescence of the discontinuous phase.

Typical proportions by mass of oxidizing salts, fuels and emulsifiers employed in the explosive are:
oxidizing salts—75–95%, preferably 91–93%
fuels—3.2–6.5%, preferably 3.4–5.1%
emulsifiers—0.95–2.0%, preferably 1.0–1.4%.

The density of the emulsion will be such as to form a suitable explosives composition after incorporation of the density reducing agent such as gas bubbles. The base emulsion may thus have a density of eg about 1.30–1.56 g/cm$^3$ at 25° C. The density of the eventual explosive should, after bubble introduction, be less than 1.26 g/cm$^3$, preferably in the range 1.15–1.20 g/cm$^3$ at 25° C.

When the oxidizing salt-containing component comprises, at least in part, ammonium nitrate, a chemical gassing agent comprising nitrite ions, eg sodium nitrite, may be employed, conveniently in the form of an aqueous solution of say 15–30% m/m concentration, eg 20% m/m, which is blended into the emulsion at said elevated temperature.

As soon as blending is initiated, nitrite ions start to react with ammonium ions in accordance with the equation $$NO_2^- + NH_4^+ \rightarrow N_2 + 2H_2O$$

to produce nitrogen bubbles.

The chemical gassing agent may thus be an aqueous nitrite solution, the discontinuous phase containing an ammonium salt and the chemical gassing agent being mixed into the emulsion by means of a static mixer.

It is desirable to form evenly distributed gas bubbles in the emulsion of an average size (diameter) in the range 20–30, eg 25 microns, and to have bubbles of a relatively uniform size, ie a relatively narrow bubble size distribution. The desired bubble size and bubble size distribution can be promoted by selecting an appropriate reaction speed and appropriate blender characteristics.

Reaction speed is controlled by the temperature and the pH for the above nitrite/ammonium reaction, and for temperatures of 85°–95° C., a pH of 3.8–4.7 has been found to be suitable, eg a pH of about 4.2 at 90° C. The blender in turn should mix the sodium nitrite solution into the base emulsion to substantial homogeneity sufficiently quickly, preferably in less than 60 seconds and more preferably in less than 40 seconds. This is effected by selecting a static mixer blender so that the turbulence created therein, arising from the flow rate therethrough, is sufficiently high, or by having sufficient mechanical agitation. Indeed, this rapid dispersion of density-reducing agent into the emulsion is desireable whatever density-reducing agent, e.g. closed-cell void-containing material such as microballoons or nitrogen gas, is used.

The amount of sodium nitrite used will depend on the proportion or number of bubbles required, ie on the eventual density required for the explosive, and, if desired, one or more catalysts such as thiourea, thiocyanate or urea may be dissolved into the discontinuous phase prior to said blending, to accelerate the nitrite/ammonium reaction.

Preferably the emulsion with bubbles should be cooled sufficiently quickly before unacceptable bubble loss, migration or coalescence has taken place, and while the bubbles are homogeneously distributed through the emulsion. Furthermore, when a wax-based formulation is used for the continuous phase, it conveniently has a hardness according to the Stanhope Penetrometer method of 10–16 mm, preferably 13.5 mm at the maximum anticipated ambient temperature of eg 35° C. and a setting point at 5°–15° C., eg 10° C., above said anticipated temperature. For this type of wax based continuous phase, cooling should be started as soon as possible after cartridging, eg 1–5 seconds thereafter or less, and the explosive in the cartridges should be cooled to the anticipated ambient temperature in no more than about 12 minutes, preferably in 5–12 minutes and typically less than 7 minutes depending on cartridge diameter. In this regard it should be borne in mind that the explosive can be pumped from the blender to the cartridging machine with sufficient turbulence to prevent any unacceptable bubble loss or coalescence, but if there is nevertheless a danger of such loss or coalescence, the blending/cartridging interval should be kept sufficiently small eg less than 5 seconds, say 1 second.

In general, the cooling step is preferably started less than 5 seconds after the cartridging step is completed.

Similarly, in general, the cooling is preferably such that the continuous phase is solidified less than 12 minutes after the cartridging step is completed.

Cooling may be by means of a cooling fluid, eg air or water, sprayed or otherwise applied to/circulated around the cartridges, preferably with turbulent flow. This cooling fluid is preferably at a temperature of no more than about 10° C. and no less than about 3° C. Water can be used for plastics cartridges and air for paper cartridges. The upper temperature limit of the cooling fluid is set by the need to form small wax crystals in the bilayer of the continuous phase as it solidifies, to permit these wax crystals to form between gas bubbles on the one hand and preferably between droplets of discontinuous phase on the other, thereby to resist bubble coalescence and droplet coalescence and, if there is any crystallization of discontinuous phase in the droplets, to resist propagation of such crystallization from one droplet to another. The small continuous phase wax crystals thus act to keep the droplets apart from one another and the bubbles apart from one another, by forming a more or less solid matrix around them, and in this regard they are more effective than the larger crystals typically obtained in the continuous phase upon slow (eg natural) cooling, which cannot penetrate as easily between adjacent droplets or adjacent bubbles.

On the other hand a cooling fluid temperature of less than 3° C. is undesirable because cooling which is too rapid can cause undesirable crystallization in the droplets of discontinuous phase, which leads to a drop in sensitivity and stability. A cooling fluid temperature of about 5° C., leading to cooling from 90° C. down to the anticipated ambient temperature of 35° C. in about 7 minutes, has been found to be adequate. A cooling device having a cartridge conveyor passing therethrough may be used for forced cooling, cooling fluid being passed through the device and the speed of the conveyor being adjusted so that the cartridges emerge from the cooling device as soon as they reach the anticipated ambient temperature. In this regard it is to be noted that forced cooling has the advantage that it can prevent expansion of the plastics cartridging material to avoid unsightly wrinkling on cooling of the cartridges, for good product appearance; and in the case of paper cartridging material where the filled cartridges can slump into an oval shape upon natural cooling, this slumping is resisted, which can be a substantial advantage for loading into round holes.

Accordingly, in particular embodiments of the process, the explosive may be cartridged into plastics cartridges, the cooling being by conveying the cartridged explosive through a cooler in which refrigerated water is sprayed onto the cartridges. Instead, the explosive is cartridges into paper cartridges, the cooling being by conveying the cartridges explosive through a cooler through which refrigerated air is circulated. As indicated above, the cooling may be such that the continuous phase is solidified less than 12 minutes after the end of the dispersion step, and may be by means of a refrigerated fluid at a temperature of 3°-10° C., the elevated temperature at which the density-reducing agent is dispersed in the emulsion preferably being 85°-95 ° C.

It is a further particular advantage of the process that, although it can be run batchwise, it lends itself to continuous operation, the base emulsion being formed continuously at an elevated temperature and being fed continuously to the blender for bubble formation, after which it is fed to a continuous cartridging process and the cartridges are fed to a continuous cooling stage. Thus, preferably, the process is a continuous process.

Typically the constituents of the base emulsion will be kept in heated stores, such as tanks, and will be fed along the process in heated flow lines and dealt with in heated items of equipment such as buffer tanks, blenders, pumps, cartridging machines, etc, until cooling is effected. This heating is preferably by means of water jackets to avoid any danger of hot spots, the water being at a temperature of eg 85°-95° C. When an emulsifier is used which is sensitive to these temperatures, it should be stored at a lower temperature but consistent with a sufficiently low viscosity thereof, and should preferably be introduced into the process upstream of the base emulsion blending at a position where it will be exposed to temperatures of 85°-95° C. for a sufficiently short time to avoid unacceptable degradation thereof. Sorbitan monooleate emulsifier, for example, should be exposed to these temperatures for no more than 60 minutes, and preferably for less than 15 minutes. Thus, the process contemplates that an emulsifier is preferably continuously added to the fuel component less than 60 minutes before the base emulsion is blended.

As regards the cooling described above, it should be noted that the rate of cooling is important, in that it should be neither too high nor too low. Furthermore, for the reasons given above, cooling should start as soon as practicable after cartridging, both to prevent migration of density reducing agent and coalescence and/or loss of bubbles when used, and to guard against coalescence of droplets of discontinuous phase, leading to poor stability. Nevertheless, cooling at too rapid a rate can adversely affect sensitivity and stability by crystallizing the discontinuous phase. By using the continuous process of the present invention, handling of large batches is avoided, allowing accurate control of cooling, and permitting cooling at the appropriate rate, immediately after cartridging. Cartridging can take place immediately after introduction of the density reducing agent.

The invention extends also to an explosive product, such as a 22 mm to 32 mm cartridged emulsion explosive, whenever produced by the process described above, specifically to 22 mm, 25 mm, 29 mm and 32 mm cartridges.

Figure 2:
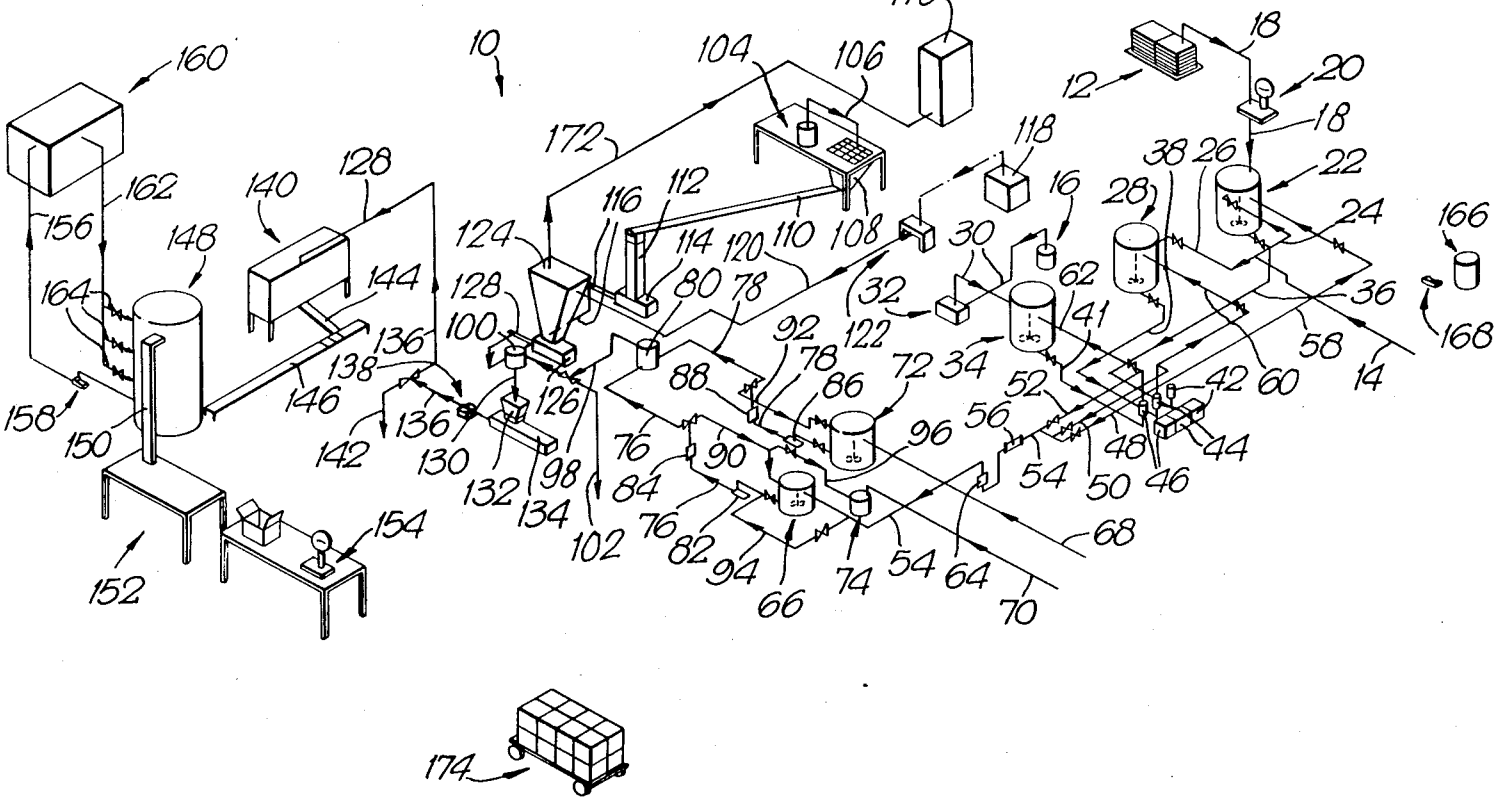

The invention will now be described, by way of example, with reference to the following non-limiting illustrative examples, and with reference to the accompanying schematic drawings, in which FIG. 1 shows a diagrammatic flow diagram of a process in accordance with the present invention wherein the density reducing agent comprises gas bubbles, and FIG. 2 shows a diagrammatic flow diagram of a process in accordance with the invention wherein the density reducing agent comprises microballoons.

In the drawings reference numeral 10 designates a flow diagram of an installation for carrying out the process of the present invention. The installation 10 comprises a wax store 12, an oil supply line 14 from a tank farm (not shown) and a surfactant store 16. The wax store 12 is connected by a flow line 18 including a weighing station 20 to a wax holding tank 22. The oil supply line 14 is in turn connected by flow lines 24 and 26, provided with shut-off valves, respectively to the wax holding tank 22 and an oil holding tank 28. The surfactant store 16, which is a tank, is connected by a flow line 30 including a pump 32, to a surfactant holding tank 34. The holding tanks 22, 28 and 34 are mixed vessels having mechanical paddles therein as shown.

The holding tanks 22, 28 and 34 feed respectively along flow lines 36, 40 and 41 to metering pumps 42, 44 and 46, each of said flow lines 36, 38 and 40 being provided with shut-off valves. The metering pumps 42, 44 and 46 respectively feed via flow lines 48, 50 and 52, provided with shut-off valves, into a common flow line 54, which feeds through a static mixer 56. The flow lines 48, 50 and 52 are respectively provided with branch flow lines 58, 60 and 62, each provided with a shut-off valve respectively for recirculating liquid back into the wax holding tank 22, into the oil holding tank 28 and into the surfactant holding tank 34.

The static mixer 56 feeds along the common flow line 54 via a flow rotameter 64 into a liquid fuel holding tank 66. Oxidizing solution and oil supply lines 68 and 70, both leading from the tank farm, lead respectively to an oxidizing solution holding tank 72 and an oil flushing tank 74. The tanks 66 and 72 feed respectively via flow lines 76 and 78 to an emulsifier device 80. The flow line 76 is provided with a pump 82 and a flow rotameter 84 and the flow line 78 is similarly provided with a pump 86 and a flow rotameter 88. The flow lines 76 and 78 are respectively provided with branch flow lines 90 and 92, for recirculating liquid fuel and oxidizing solution respectively to the tanks 66 and 72. The tanks 66 and 72 are mixing tanks provided with paddles, and the flow line 92 is provided with a shut-off valve.

The oil flushing tank 74 feeds via a flow line 94 provided with a shut-off valve into the flow line 76, and a flow line 96 provided with a shut-off valve, leads from the flow line 90 into the oil flushing tank 74. In this regard it should be noted that, in the flow lines 76 and 78, the respective pumps 82 and 86 are upstream of the respective rotameters 84 and 88, and each of said flow lines 76, 78 has a shut-off valve, the shut-off valves being respectively upstream of the associated pumps 82, 86, the flow line 90 branching at a three-way shut-off valve from the flow line 76 between the rotameter 84 and the emulsifier device 80, and the flow line 92 branching at a three-way shut-off valve from the flow line 78 between the rotameter 88 and emulsifier device 80. The flow line 94 enters the flow line 76 between the pump 82 and the shut-off valve in the line 76.

The emulsifier device 80 leads via a flow line 98 to a dry dopes blender 100, the flow line 98 being provided with a branch flow line 102 branching from a three-way valve to a waste store (not shown).

An atomized aluminium store 104 leads in series via a flow line 106, hopper 108 and flexible auger 110 to a hopper 112 which is turn leads in series via an auger 114 and flow line 116 to the blender 100.

A sodium nitrite store 118, which is a mixing tank provided with a paddle, leads via a pump 120 feeding into a flow line 122, to a gassing blender 124, which has a discharge flow line 128.

The blender 100 feeds via flow line 130 and hopper 132 to a blended product pump 134 which discharges via a flow line 136 to the gassing blender 124, the flow line 122 entering the flow line 136 immediately upstream of the blender 124. The flow line 128 leads to a cartridging machine 140. The flow line 136 is provided with a branch flow line 142 branching from a three-way valve to a waste store (not shown).

The cartridging machine 140 feeds via a cartridge chute or slide 144 on to a cartridge conveyor 146 which leads to a cooling device 148. The cooling device 148 discharges via a chute 150 to a packaging facility or station generally designated 152 and provided with weighing means 154.

The cooling device 148 is a so-called spiral chiller of the type used in the food industry, typically used for chilling processed foods, such as hamburger patties. The Applicant has found that this device is entirely suitable for chilling cartridges of explosives. The device in question is obtainable from Grenco South Africa (Proprietary) Limited, Kempton Park. The cooling device 148 is of stainless steel construction and has a variable speed spirally arranged conveyor in its interior, for conveying articles to be chilled from its lower end, into which the conveyor 146 feeds, to its upper end, where the variable speed conveyor feeds into the chute 150. In its interior the device 148 has a plurality of spaced nozzles, suitable for spraying chilled water or recirculated cooled air on to articles passing through the device 148.

In the drawings the cooling device 148 is shown connected to a flow line 156 provided with a pump/-blower 158, leading to a refrigeration plant 160. A flow line 162 returns from the refrigeration plant 160 and branches into three feed lines 164 each provided with a shut-off valve, and leading respectively to nozzles in the interior of the device 148.

With regard to the installation 10 shown in the drawing, it should be noted that the tanks 22 and 28 are provided with steam coils, and the various flow lines for carrying the contents of these tanks in a downstream direction to the cartridging machine 140 are provided with water jackets. These water jackets have water circulating therethrough at about 95° C. The jacketed flow lines include the flow lines 36 and 38, the flow lines 48, 50 and 54, the recirculation flow lines 58 and 60, flow line 76, and recirculation flow line 90 and flow lines 98, 102, 136 and 142. Flow line 68 is steam traced. Various other items such as the tank 66 will have a low pressure steam coil at the same temperature, as can, if desired, items such as emulsifiers, blenders, pumps, mixers, rotameters, etc, where practicable, or at least such items can be lagged to prevent heat loss. In this regard a calorifier is shown at a 166 with an associated pump 168 for providing hot water at 95° C. for the water jacketing. Tank 72, with flow lines 78 and 92 and feed line 68 are steam jacketed to obviate solution fudging problems.

Similarly, the tank 34 and the associated flow lines 52 and 62, are supplied with a means of electrical heating to maintain a temperature of about 35°–40° C. as explained hereunder.

Finally, it should be noted that a trolley carrying boxes of cartridged explosives is shown at 170, downstream of the packing station 152.

Waxes are transported from the wax store 12 along flow line 18 to the tank 22, being weighted at the weighing station 20. In the tank 22 the wax is melted at 90° C., and circulated by the paddle at 90° C. Oil from the flow line 14 passes along flow line 26 to the tank 28, where it is mixed and heated to 90° C.

The wax blend from the tank 22 is pumped via metering pump 42 along flow lines 36 and 48 to the flow line 54, as is oil from the tank 28 by means of the metering pump 44 along flow lines 40 and 50. Simultaneously, surfactant is pumped from the surfactant store 16 along flow line 30 by pump 32 to the tank 34, where it is electrically heated to 35°–40° C. Surfactant is then pumped by metering pump 46 along flow lines 41 and 52 to the flow line 54. In this regard it should be noted that, if for any reason flow along flow line 54 is stopped, the metering pumps 42, 44 and 46 can continue to operate, recirculating respectively wax blend along flow line 58 to the tank 22, oil along flow line 60 to the tank 28 and surfactant along the flow line 62 to the tank 34.

In the flow line 54 mixing of emulsifier, wax blend and oil takes place in the static mixer 56, and this flow is metered by the rotameter 64. The mixed fuel blend passes along flow line 54 to the tank 66.

Oxidizing solution from the tank farm simultaneously passes along flow line 68 to the tank 72, and fuel and oxidizing solution are simultaneously pumped respectively from the tanks 66 and 72 via the associated pumps 82 and 86 and flow lines 76 and 78 to the emulsifier device 80. In this regard it should be noted that, should flow through the emulsifier device 80 be stopped for any reason, the pump 82 can recirculate fuel to the tank 66 via flow line 90, and the pump 86 can recirculate oxidizing solution via flow line 92 to the tank 72. The flow line 70 is for supplying flushing oil from the tank farm, which oil is stored in tank 74, and can be used via flow lines 94, 90 and 96, to flush the flow line 76 upstream of its connection to the flow line 90, the pump 82, the flow line 90 and with the tank 66.

In the emulsifier device 100 the fuel and oxidizing salt solution are emulsified and emulsified fuel/oxidizer base emulsion passes from the emulsifier device 80 along flow line 98 to the blender 100, the flow line 102 carrying this flow to waste when desired, eg should flow through the blender 100 be stopped for any reason.

When sorbitan oleate is used as the emulsifier, it should be noted that the flow thereof along line 52 at 35°–40° C. enters the flow line 54 close to the static mixer 56, so that the emulsifier is dispersed throughout the fuel very shortly after its temperature is increased to 90° C. in the flow line 54. Furthermore, the capacity of the liquid fuel tank 66 and the lengths of the flow lines 54 and 76 are selected, so that fuel containing emulsifier entering the flow line 54 passes through the emulsifier device 80 no later than 15 minutes after entering the flow line 54. This is because sorbitan oleate can be degraded at 90° C., so that the emulsion must be formed quickly.

Simultaneously, atomized aluminium is fed from the store 104 along flow line 106 and through the hopper 108 to the auger 110. The auger 110 passes said atomized aluminium through the hopper 112 and auger 114 via flow line 116 into the blender 100.

In the blender 100 the base emulsion from the emulsifier device 80 is blended with atomized aluminum from the flow line 116. From the blender 100 the base emulsion/aluminium mixture passes via flow line 150 and hopper 132 through pump 134 and flow line 136 via density gauge 138 to the blender 124. Simultaneously, sodium nitrite is fed by the pump 120 from the store 118 along flow line 122 to the blender 124. In the blender 124 sodium nitrite is blended into the base emulsion-/aluminium mixture, and the blended explosive then passes from the blender 124 along flow line 128 to the cartridging machine 140 where the explosive is cartridged into cartridges continuously and automatically. The blender 124 optionally has a water jacket or lagging, to maintain its temperature as close as practicable to 90° C. Should the cartridging machine 140 cease operation blended base emulsion can pass along flow line 142 to waste.

From the cartridging machine 140, cartridges filled with explosive pass along chute 144 to conveyor 146, and along conveyor 146 into the cooling device 148. The cartridges pass upwardly through the cooling device 148, in which they have chilled water sprayed on them, or chilled air directed at them, depending on whether the cartridging material is a plastics material or paper. Chilled cartridges emerge from the top of the cooling device 148 and pass via chute 150 to the packing station 125 where they are packed into cartons, which are then weighed on the weighing means 154 and removed on trolleys, eg as shown at 170.

The spent cooling water or air, as the case may be, is recirculated from the cooling device 148 by means of the pump blower 158 through the flow line 156 to the refrigeration plant 160, where it is continuously chilled, and then returned along flow line 162 to the flow lines 164.

The base emulsion entering the blender 124 will contain ammonium nitrate, and ammonium ions in the blended explosive will react with nitrite ions from the sodium nitrite according to the reaction:

$$NO_2^- + NH_4^+ \rightarrow N_2 + 2H_2O$$

to produce bubbles of nitrogen as a density reducing agent in the explosive. These bubbles form and grow in the explosive in the flow line 128 and cartridging machine 140, and in the cartridges after cartridging, the pH of the oxidizing solution from the flow line 68 being adjusted appropriately to 4,0 and the oxidizing solution containing thiourea accelerator for the above reaction.

As regards the operation of the cooling device 148, water will be sprayed into the chiller 148 at about 7° C. or air at about 5°–7° C., the variable speed conveyor in the device 148 being set at a speed such that the cartridges emerge along chute 150 at a temperature no greater than 35° C. In this regard it should be noted that the capacity of the cooling device 148 will be selected such that its throughput is greater than that of the cartridging machine 140 and such that the residence time of cartridges in the device 148 is about 7 minutes. It should further be noted that the chute 144 and conveyor 146 are selected and constructed so that cartridges are conveyed quickly from the cartridging machine 140 to the cooling device 148, preferably in about 1–5 seconds, so that cooling in the device 148 is initiated before any unacceptable migration/segregation of bubbles takes place in the hot explosive in the cartridges; and so that the continuous fuel phase of the explosive solidifies and crystallizes with a fine grain or crystal structure.

The short interval between cartridging and cooling will also serve to prevent any unacceptable coalescence or loss of bubbles introduced into the cartridged explosive, and rapid solidification of the emulsion, whose wax constituents are selected to ensure solidification thereof at temperatures not less than 35° C., entraps and fixes in place the bubbles in the explosive product, as well as the droplets of discontinuous phase formed by the oxidizing solution.

In the flow diagram of the modified process shown in FIG. 2 the sodium nitrite store is replaced by a microballoon store 118 which leads via a flow line 120 provided with a pump 122 to a hopper 124 provided with an auger 126 leading via flow line 128 into the blender 100. The hopper 124 is vented by a venting unit 170 connected to the hopper 124 by a flow line 172, and the trolley carrying boxes of cartridged explosives is depicted as 174.

In tests conducted with the installation 10 shown in the drawing, it was found that the rapid cooling of the explosive caused the continuous phase of the emulsion, formed by the fuel component to form relatively small crystals. These crystals penetrated between droplets of the discontinuous oxidizing salt phase to separate them and resist their coalescence, and the wax crystals also penetrated between gas bubbles to maintain an even distribution thereof throughout the explosive in the cartridges and to prevent or at least resist coalescence and loss of gas bubbles. This forced cooling, which starts before any material natural cooling of the cartridges can take place, is to be contrasted with natural cooling where the continuous phase crystallizes slowly with formation of large crystals and the associated disadvantages. Furthermore, it was noted that if cooling took place too rapidly or took place with cooling fluid which was too cold, undesirable crystallization of the discontinuous phase could take place, with the associated disadvantage of a drop in stability.

EXAMPLES

Cartridged oil-in-water emulsion explosives were prepared according to the process of the present invention described above and by means of the installation shown in the drawing, having the following compositions, in which all units are expressed as parts on a mass basis:

| Constituent | Sample 1 | Sample 2 | Sample 3 |
|---|---|---|---|
| Ammonium nitrate (88% m/m aqueous solution) | 79,54 | 77,88 | 76,14 |
| Sodium nitrate (dissolved in the ammonium nitrate solution) | 13,07 | 12,67 | 12,51 |
| Thiourea (Catalyst) | 0,1 | 0,1 | 0,1 |
| Water (added to the ammonium nitrate solution) | 0,78 | 0,47 | 0,7 |
| P95 Oil | 0,99 | 0,8 | 0,66 |
| Crill 4 (sorbitan mono-oleate emulsifier) | 1,39 | 1,17 | 1,00 |
| Paraffin Wax (Aristo) | 2,02 | 1,66 | 1,4 |
| Microcrystalline Wax (BE SQUARE Amber) | 2,02 | 1,66 | 1,4 |
| Atomized Aluminium (Supramex 2022) | | 3,5 | 6,00 |
| Sodium nitrite | 0,09 | 0,09 | 0,09 |
| TOTAL | 100,00 | 100,00 | 100,00 |
| Cold Density (g/ml) | 1,15 | 1,18 | — |

| Constituent | Sample 4 | Sample 5 | Sample 6 |
|---|---|---|---|
| Ammonium nitrate (88% m/m aqueous solution) | 79,58 | 77,92 | 76,18 |
| Sodium nitrate (dissolved in the ammonium nitrate solution) | 13,07 | 12,67 | 12,51 |
| Thiourea (Catalyst) | 0,06 | 0,06 | 0,06 |
| Water (added to the ammonium nitrate solution) | 0,78 | 0,47 | 0,70 |
| P95 Oil | 0,99 | 0,80 | 0,66 |
| Emulsifier | 1,39 | 1,17 | 1,00 |
| Paraffin Wax (Nippon 150/155) | 2,63 | 2,16 | 1,82 |
| Microcrystalline Wax (Indramic 7080) | 1,41 | 1,16 | 0,98 |
| Atomized Aluminium (Supramex 2022) | Nil | 3,50 | 6,00 |
| Sodium Nitrite | 0,09 | 0,09 | 0,09 |
| TOTAL | 100,00 | 100,00 | 100,00 |
| Cold Density | 1,12–1,18 g/ml | 1,12–1,18 g/ml | 1,12–1,18 g/ml |

| Constituent | Sample 7 | Sample 8 | Sample 9 |
|---|---|---|---|
| Ammonium nitrate (88% m/m aqueous solution) | 76,51 | 74,44 | 72,86 |
| Sodium nitrate (dissolved in the ammonium nitrate solution) | 12,57 | 12,13 | 11,97 |
| Water (added to the ammonium nitrate solution) | 0,75 | 0,66 | 0,67 |
| P95 Oil | 0,95 | 0,77 | 0,64 |
| Crill 4 (sorbitan mono-oleate emulsifier) | 1,34 | 1,12 | 0,96 |

-continued

| | | | |
|---|---|---|---|
| Paraffin Wax (Aristo) | 1,94 | 1,59 | 1,35 |
| Microcrystalline Wax (BE SQUARE Amber) | 1,94 | 1,59 | 1,35 |
| 3M B23/500 Microballoons | 4,00 | 4,20 | 4,20 |
| Atomized Aluminium (Supramex 2022) | | 3.5 6.00 | |
| TOTAL | 100,00 | 100,00 | 100,00 |
| Cold Density (g/cm$^3$) | 1,10–1,15 | 1,10–1,15 | 1,10–1.15 |

| Constituent | Sample 10 | Sample 11 | Sample 12 |
|---|---|---|---|
| Ammonium nitrate (88% m/m aqueous solution) | 76,51 | 74,44 | 72,86 |
| Sodium nitrate (dissolved in the ammonium nitrate solution) | 12,57 | 12,13 | 11,97 |
| Water (added to the ammonium nitrate solution) | 0,75 | 0,66 | 0,67 |
| P95 Oil | 0,95 | 0,77 | 0,64 |
| Soya Lecithin | 0,67 | 0,56 | 0,48 |
| Crill 4 (sorbitan mono-oleate emulsifier) | 0,67 | 0,56 | 0,48 |
| Paraffin Wax (Aristo) | 1,94 | 1,59 | 1,35 |
| Microcrystalline Wax (BE SQUARE Amber) | 1,94 | 1,59 | 1,35 |
| 3M B23/500 Microballoons | 4,00 | 4,20 | 4,20 |
| Atomized Aluminium (Supramex 2022) | | 3,5 | 6,00 |
| TOTAL | 100,00 | 100,00 | 100,00 |
| Cold Density (g/cm$^3$) | 1,10–1,15 | 1,10–1,15 | 1,10–1,15 |

The P95 mineral oil was obtained from B P South Africa (Proprietary) Limited, and the Crill 4 from Croda Chemicals South Africa (Proprietary) Limited. The paraffin wax (Aristo) was Aristo wax obtained from Sasol Chemicals (Proprietary) Limited, and Nippon 150/155 obtained from Industrial Raw Materials (Proprietary) Limited; the microcrystalline wax was BE SQUARE Amber 175 obtained from Bareco Inc. USA and Indramic 7080 obtained from Industrial Raw Materials (Proprietary) Limited. The Microballoons were 3M B23/500 glass microballoons obtained from 3M South Africa (Propritary) Limited, and the Supramex 2022 atomized aluminium was obtained from Hulett Aluminium Limited. The soya lecithin was obtained from Holpro Chemicals (Proprietary) Limited.

In samples 4 to 6 and 10 to 12 the emulsifier was a 50:50 m/m mixture of Crill 4 and Soya Lecithin.

The samples were cooled to a temperature of 15°–18° C. Cartridges were employed of a crimp-to-crimp length of 195–205 mm and cartridged diameters of 25 and 32 mm were made. In each case explosives were obtained with good sensitivity and good stability/shelf life. Cartridge made in accordance with the process of the invention were found to have a shelf life of 9 to 12 months, as compared with about 6 months for controls where forced cooling was omitted, the control explosives being manufactured in a similar fashion but with natural cooling. Initial sensitivities were also found to be improved relative to the controls by the forced cooling, believed to be attributable to a lack of coalescence of droplets of the discontinuous phase.

The explosive compositions of the invention are highly sensitive and may fire on a 2D detonator containing 22.5 mg pentaerythritol tetranitrate. Velocities of detonation ranged between 4.0 and 4.7 km/s. and the gap sensitivity was about 50 mm. Bubble energies vary between 1.80 and 1.21 MJ/kg. The explosives performed satisfactorily after harsh handling.

We claim:

1. In the production of a cartridge explosive in the form of an emulsion which comprises a discontinuous phase which forms an oxidizing salt-containing component and a continuous phase which is immiscible with the discontinuous phase and which forms a fuel component which is solid at ambient temperatures, a process which comprises the steps of introducing a density-reducing agent into the emulsion and dispersing it therein while the emulsion is at an elevated temperature and is essentially liquid to form an explosive, cartridging the explosive containing the density reducing agent, and then cooling the cartridged explosive by means of a refrigerated fluid having a temperature of 3° to 10° C. so that the continuous phase solidifies, thereby to entrap the density-reducing agent and stabilize its dispersion in the explosive, the cooling step being started less than 5 seconds after the cartridging step is completed and being such that the continuous phase is solidified less than 12 minutes after the dispersion step whereby migration of the density-reducing agent and undesirable crystallisation of the discontinuous phase are prevented.

2. A process as claimed in claim 1 wherein constituents of a base emulsion are continuously blended to form a base emulsion, the base emulsion so formed is continuously fed to a blender where it is continuously blended with a density-reducing agent to form a sensitized emulsion explosive, and the explosive so formed is continuously cartridged and the cartridges are then continuously cooled, the blending and cartridging taking place at an elevated temperature at which the constituents of the base emulsion are liquid.

3. A process as claimed in claim 1 wherein the density reducing agent is selected from the group consisting of gas bubbles and closed-cell void containing materials.

4. A process as claimed in claim 3, in which the gas bubbles are introduced and dispersed into the emulsion by mixing a chemical gassing agent into the emulsion, the chemical gassing agent being allowed to form bubbles in the emulsion before the continuous phase solidifies.

5. A process as claimed in claim 4, in which the chemical gassing agent is an aqueous nitrite solution and the discontinuous phase contains an ammonium salt.

6. A process as claimed in claim 1 in which the cooling is effected by forced cooling whereby the refrigerated fluid is caused to flow over the cartridged explosive.

7. A process as claimed in claim 6, in which the explosive is cartridged into plastics cartridges, the cooling being by conveying the cartridged explosive through a cooler in which refrigerated water is sprayed onto the cartridges.

8. A process as claimed in claim 6, in which the explosive is cartridged into paper cartridges, the cooling being by conveying the cartridged explosive through a cooler through which refrigerated air is circulated.

9. A process as claimed in claim 1, in which an emulsifier is continuously added to the fuel component less than 60 minutes before the constituents of the base emulsion are blended.

10. A process as claimed in claim 1, in which the elevated temperature at which the density-reducing agent is dispersed in the emulsion is 85°–95° C.

11. A process as claimed in claim 2, in which the density-reducing agent comprises gas bubbles generated by blending a nitrite with a base emulsion which contains an ammonium salt in its discontinuous phase in a blending step which lasts for less than 60 seconds.

12. A cartridged explosive whenever produced according to the process of claim 1.

* * * * *